United States Patent [19]

Itagaki et al.

[11] 4,411,600

[45] Oct. 25, 1983

[54] HERMETIC MOTOR COMPRESSOR

[75] Inventors: Masato Itagaki; Fumio Harada; Tetsuya Arata, all of Shimizu, Japan

[73] Assignee: Hitachi, Ltd., Tokyo, Japan

[21] Appl. No.: 205,110

[22] Filed: Nov. 10, 1980

[30] Foreign Application Priority Data

Nov. 9, 1979 [JP] Japan ..... 54-144392

[51] Int. Cl.[3] ..... F04B 39/00

[52] U.S. Cl. ..... 417/312; 417/373; 417/424; 417/902

[58] Field of Search ..... 417/902, 312, 363, 569, 417/570, 571, 424, 373; 181/403

[56] References Cited

U.S. PATENT DOCUMENTS

| | | | |
|---|---|---|---|
| 3,075,686 | 1/1963 | Steinhagen | 417/363 |
| 3,187,996 | 6/1965 | Roelsgaard | 417/902 X |
| 3,401,873 | 9/1968 | Privon et al. | 417/312 X |
| 3,817,661 | 6/1974 | Ingalls et al. | 417/902 X |
| 4,057,979 | 11/1977 | Abell et al. | 417/902 X |
| 4,140,439 | 2/1979 | Imasu | 417/902 X |
| 4,239,461 | 12/1980 | Elson | 417/312 |

*Primary Examiner*—Edward K. Look

*Attorney, Agent, or Firm*—Antonelli, Terry & Wands

[57] ABSTRACT

A hermetic motor compressor having a motor compressor unit including an upper motor section and a lower compressor section connected with each other and a closed housing accommodating therein the motor compressor unit. The compressor section includes a frame body forming a cylinder, a cylinder head provided with a discharge valve and a suction valve and a head cover in which only a discharge chamber is formed. A suction chamber of a small volume is formed in the frame body at a portion around the cylinder and is communicated with the upper part of a space in the closed housing through an upright suction pipe made of a synthetic resin.

6 Claims, 9 Drawing Figures

HERMETIC MOTOR COMPRESSOR

BACKGROUND OF THE INVENTION

The present invention relates to a hermetic motor compressor suitable for use for the compression of refrigerant in air conditioners and refrigerators.

Air conditioners or refrigerators incorporate a closed refrigerant circuit constituted by a refrigerant compressor, condenser, pressure reducer and an evaporator which are connected in series by refrigerant pipes.

The compressed refrigerant gas discharged from the refrigerant compressor is cooled and liquefied in the condenser, and the liquefied refrigerant flows, after a pressure reduction by the pressure reducer, to the evaporator. The liquid refrigerant of lowered pressure is evaporated in the evaporator through heat absorption from a fluid which serves as a cooling object, to become gaseous refrigerant which then is recycled to the refrigerant compressor thus completing one cycle of operation. The fluid serving as the cooling object is cooled in the evaporator through heat exchange with the refrigerant, and is forwarded for the purpose of air conditioning or refrigeration.

The use of a hermetic motor compressor as the refrigerant compressor has become popular. The hermetic motor compressor has a closed housing in which a motor section and a compressor section are assembled as a unit.

The compressor section has a cylinder formed integrally with the frame. A cylinder head provided at one end of the cylinder has a suction valve and a discharge valve. A head cover is disposed at the outside of the cylinder head. A suction chamber and a discharge chamber are formed in the head cover. A vertical suction pipe provided in the suction chamber extends to open at an upper part of the space within the closed housing. The cylinder accomodates a piston adapted to make a reciprocatory motion therein. The piston is connected to a crank shaft through a connecting rod.

The motor section has a stator fixed to a plurality of supporting posts provided around the frame, and a rotor disposed at the inside of the stator and coupled to a motor shaft which is integral with the crank shaft.

In operation, the refrigerant gas is sucked into the closed housing through a return pipe connected to the latter, and is sucked into the suction chamber formed in the head cover. The refrigerant gas is then sucked into the cylinder by forcibly opening the suction valve due to the pressure differential across the latter.

The refrigerant gas sucked into the cylinder is compressed by the reciprocating piston and is discharged to the discharge chamber in the head cover by forcibly opening the discharge valve. The compressed refrigerant gas is then delivered to the outside of the motor compressor through the discharge pipe and a discharge silencer.

The sliding parts of the motor compressor are lubricated and cooled by lubricant sucked up from an oil storage pan formed at the bottom of the closed housing.

To explain the construction of the head cover in more detail, the discharge portion is formed in the extension of the cylinder, and the suction chamber is formed therearound. The outside dimensions of the head cover is determined by the size of the frame constituting the cylinder. In addition, since the discharge valve portion has a diameter smaller than that of the cylinder, the suction chamber formed in the head cover is made to have a comparatively large volume.

The hermetic motor compressor having the described construction is incorporated in the closed loop of refrigerant circuit. If this hermetic motor compressor has a temperature lower than those of other constituents of the refrigerant circuit, or if the same is located at a height below other constituents, the refrigerant of the refrigerant circuit concentrates at the closed housing of the motor compressor during suspension of operation, and is liquefied to be mixed with refrigerator oil in the housing.

The head cover and other associated members, made of metallic materials, have large heat capacity so that the gaseous refrigerant therearound is liquefied to become liquid refrigerant due to a heat absorption by these metallic parts. The refrigerant liquefied in the head cover is collected at the lower part of the suction chamber. Since the suction chamber has a large space as mentioned before, the area of the inner surface of the suction chamber is correspondingly large, so that a large amount of refrigerant is liquefied in the suction chamber.

As the compressor is started in this state, the mixture liquid in the cylinder is discharged during the first rotation. The pressure established in the cylinder in the first stroking of the piston is not very high because the rotation speed is still low in this state. In the suction stroke of the next rotation, the liquid refrigerant residing just above the suction valve is sucked as the suction valve is opened. Since the piston moves in this state at a speed higher than that of the first rotation, the internal pressure of the cylinder is increased to an abnormally high level. This phenomenon lasts till the liquid refrigerant in the suction chamber is completely sucked and discharged. In consequence, the suction valve, cylinder head, discharge chamber, packing bearings and other parts are subjected to excessively large mechanical force. If this abnormal pressure increase takes place often, the concerned parts of the compressor may be broken due to fatigue, resulting in a shortened life of the compressor, as well as increased level of noise.

In addition, since the suction chamber is formed in the head cover, the suction chamber is overheated by the heat produced in the discharge chamber. In consequence, the refrigerant gas is heated just before entering the cylinder, resulting in an increase in the specific volume of the refrigerant gas, and a lowering of the volmetric efficiency of the compressor.

The specification of prior U.S. Pat. No. 3,817,661 discloses a motor compressor for air conditioner, in which the cylinder head of the compressor is provided with a silencing mechanism to eliminate the noise generated by the sucked refrigerant gas to improve the performance of the motor compressor. More specifically, in this motor compressor, the cylinder head is divided by an acoustic partition place into an upper chamber and a lower chamber which are communicated with each other by means of an orifice having a restricted passage. This lower chamber has a central discharge chamber around which is formed a suction chamber consisting of three sections communicated with one another through restricted passages.

The refrigerant gas flows into the closed housing through the return pipe and via a filter and comes into the upper chamber through the end of the suction pipe. As the gas is relieved into the upper chamber, it is allowed to expand so that a silencing effect is obtained.

The refrigerant gas then flows into the chamber, in which it is further expanded to produce the silencing effect.

The suction chamber acting also as a silencer is formed in the head cover of the cylinder head and around the discharge chamber, also in the hermetic motor compressor of the type stated above.

SUMMARY OF THE INVENTION

It is, therefore, an object of the invention to provide a hermetic motor compressor in which the abnormal increase of the internal pressure of cylinder, which often takes place in the conventional motor compressor, is fairly avoided, and the number of occurrences of such abnormal pressure increase is reduced to ensure longer life of the compressor parts such as the suction valve, discharge valve, cylinder head, head cover, packing, bearings and so forth, through freeing these parts from the abnormal pressure and mechanical force.

Another object of the invention is to provide a hermetic motor compressor in which the heating of the sucked refrigerant gas by the heat radiated from the hot discharging section is avoided to increase the volumetric efficiency of the compressor to improve the performance of the compressor and the refrigeration power of the refrigeration system.

To these ends, according to the invention, there is provided a hermetic motor compressor of the type having a closed housing accomodating a motor section and a compressor section which are made integral with each other, the closed housing being provided at its upper part with a suction passage opening thereto so that the sucked gas is induced to the compressor section through the suction passage, wherein the improvement comprises that a suction chamber at the upstream side of a suction valve is formed in a frame forming therein a cylinder at a portion adjacent to a periphery of the cylinder, to have a small volume, and that a suction passage made of a plastic is formed to stand upright from the suction chamber.

The refrigerant gas of the refrigeration system is introduced from an evaporator to the closed housing of the hermetic motor compressor through a refrigerant return pipe. This refrigerant gas is sucked into the cylinder from the suction passage via the suction chamber formed adjacent to the periphery of the cylinder, and is compressed by the reciprocating piston. The compressed refrigerant gas of high temperature and pressure is then discharged to the discharge chamber in the head cover, and is delivered to the outside of the hermetic motor compressor through the delivery pipe. The refrigerant gas is then introduced into the condenser.

According to the invention, the suction chamber is formed in the frame outside the cylinder to have a small volume and, hence, a small surface area, apart from the discharge chamber in the head cover. In addition, the suction passage is constituted by a plastic suction pipe or a plastic suction silencer disposed in the suction chamber in upright posture, the amount of storage of liquid refrigerant in the suction chamber during suspension of operation is much reduced, and the number of liquid compressions after the start-up is decreased to prevent the building up of abnormally high pressure in the cylinder. In consequence, the compressor parts such as suction valve, discharge valve, cylinder head, head cover, packing and bearings are freed from application of abnormally high pressure and mechanical force, to ensure a longer life of the compressor, while attaining reduction of noise at the time of start-up of the compressor.

Furthermore, the heating of the sucked gas is prevented to avoid the increase of the specific volume of the refrigerant gas, so that the volumetric efficiency of the compressor is increased to promise improved performance of the compressor and increased refrigeration power of the refrigeration system incorporating the compressor.

The above and other objects, as well as advantageous features of the invention will become clear from the following description of the preferred embodiment of the invention taken in conjunction with the accompanying drawings.

DESCRIPTION OF THE PREFERRED EMBODIMENTS

Figure 1:
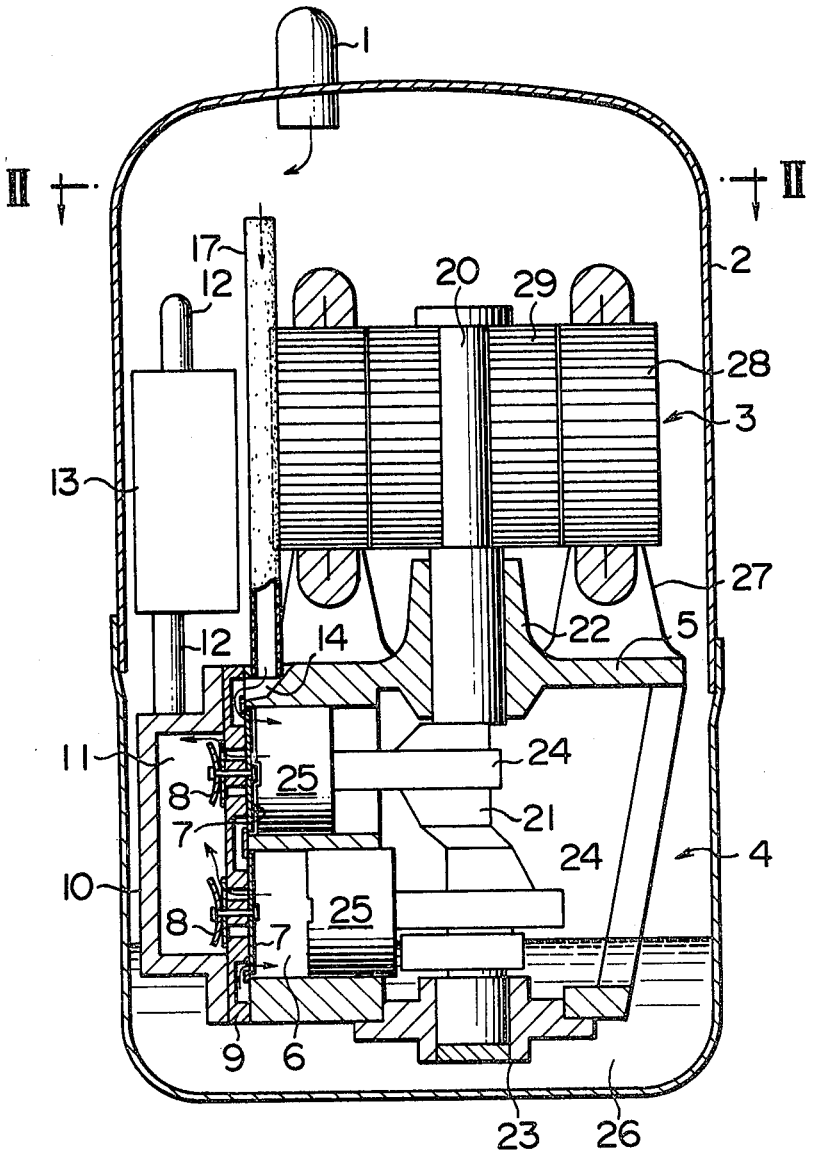
FIG. 1 is a longitudinal sectional view of a hermetic motor compressor constructed in accordance with an embodiment of the invention.
Figure 2:
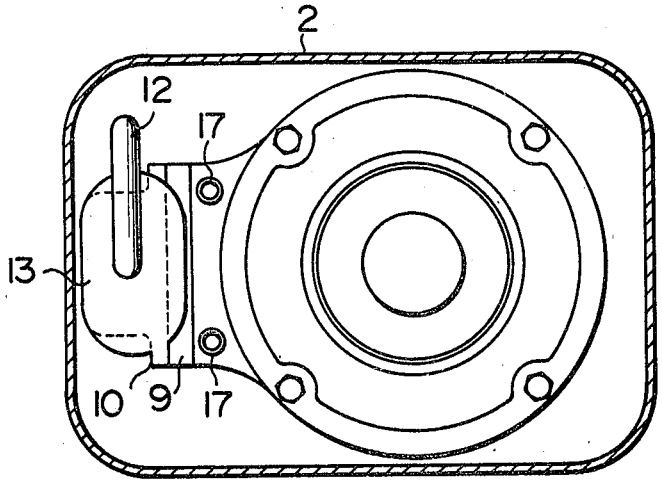
FIG. 2 is a plan view of the hermatic motor compressor shown in FIG. 1, as viewed in the directions of the arrow lines II—II with the upper part of a closed housing sectioned and removed.

FIGS. 1 and 2 show a hermetic motor compressor constructed in accordance with an embodiment of the invention.

The hermetic motor compressor of this embodiment has a closed housing 2 provided with a refrigerant return pipe 1. The closed housing 2 accommodating a motor compressor unit consisting of an upper motor section 3 and a lower compressor section 4. The motor compressor unit as one body is attached to the inner surface of the closed housing through a resilient mounting means which is neglected from the drawings.

The compressor section 4 has cylinders 6 formed as a unit with frame 5. A cylinder head 9 attached to one end of the cylinders 6 is provided with suction valves 7 and discharge valves 8. A head cover 10 is disposed at the outside of the cylinder head 9. The head cover defines therein only a discharge chamber 11. A discharge pipe 12, provided at its intermediate portion with a discharge silencer 13, is formed to stand upright from the outer wall of the head cover 10. The discharge pipe 12 is extended to the outside of the hermetic motor compressor through the wall of the closed housing.

Figure 3:
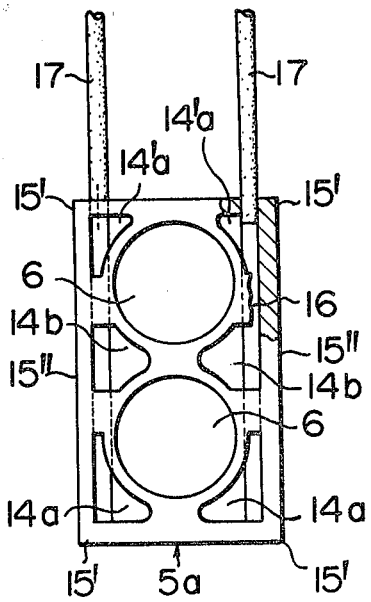
FIG. 3 shows an end view of a cylinder, as well as a suction pipe, of the hermetic motor compressor shown in FIG. 1, with a corner of the frame body being removed.

As will be seen from FIG. 3, a suction chamber 14 is formed in a frame body 5*a* forming the cylinders 6 at a portion around the cylinders, particularly at corners 15′ and the outer side portions 15″ between the two cylinders. The suction chamber has a suitable small axial length and is constituted by suction chamber sections 14*a*, 14*b* of small volumes. The suction chamber sections 14*a*, 14*b* are communicated with each other through passages 16.

Suction pipes 17 made of a synthetic resin stand upward from the upper suction chamber sections 14*a*′, 14*a*′ and extend to open at an upper part of the space within the closed housing.

Since the suction chamber sections 14*a*, 14*b* are formed at the corner portions of the frame body 5*a* around the cylinder 6 to have small axial length, the volume of the suction chamber as a whole is much smaller than that of the prior art formed around the discharge chamber of the cylinder head.

A crank shaft 21 integral with a motor shaft 20 is supported by an upper bearing 22 formed in the frame 5 and a lower bearing 23 formed at a lower part of the frame 5, and is connected through connecting rods 24 to pistons 25 received by respective cylinders 6. The bottom of the closed housing 2 constitutes an oil pan in which stored is the lubricating oil 26.

The motor section 3 is constituted by a stator 28 fixed to a plurality of vertical support legs 27 which are provided at the peripheral portion of the frame 5, and a rotor 29 disposed at the inside of the stator 28 and fixed to the motor shaft 20.

The refrigerant gas of low temperature flowing through the refrigerant return pipe 1 into the closed housing 2 is sucked into the suction pipes 17. A part of the refrigerant gas is distributed in the closed housing. The refrigerant sucked through the suction pipes 17 then flows into the suction chamber 14 and is sucked into the cylinders 6 forcibly opening respective suction valves 7 due to the pressure differential across the latter, so as to be compressed by the reciprocating pistons 25. The compressed refrigerant gas is discharged to the discharge chamber 11 forcibly opening the discharge valves 8, and is delivered to the outside of the hermetic motor compressor through the discharge pipe 12 and the discharge silencer 13. The lubricating oil 26 stored at the bottom of the closed housing is supplied to sliding parts of the compressor to lubricate and cool the latter.

Since the suction chamber 14 is formed at the portion of the frame body 5*a* around the cylinder to have small volume and apart from the discharge chamber 11, the heat transfer from the hot discharge chamber 11 to the suction chamber 14 is sufficiently suppressed. In addition, since the area of the metallic walls constituting the suction chamber 14 and contacting the sucked cold refrigerant gas is made sufficiently small, the undesirable heating of the sucked refrigerant gas through the metallic walls is very much reduced. Furthermore, the refrigerant gas sucked through the suction pipes 17 into the compressor section is sufficiently insulated from the heat of the atmospheric gas in the closed housing, as well as from the heat generated by the motor section 3, because the suction pipes are made of synthetic resin, so that the heating of the sucked refrigerant gas is fairly avoided.

During suspension of the motor compressor, a large amount of refrigerant is returned into the closed housing 2 and the refrigerant in the liquid state is stored in the suction chamber 14. The aforementioned abnormal pressure increase will take place, in the conventional motor compressor, if the latter is started in this state. This problem, however, is overcome in the motor compressor of the invention, as will be understood from the following description.

In the first compression caused by the first reciprocating motion of the piston 25, the mixture of the refrigerant in the gaseous phase and the refrigerant in the liquid phase sucked into each cylinder 6 is compressed so that the pressure in the cylinder 6 is increased to some extent. However, since the suction chamber 14 has a small volume as stated before, the amount of liquid staying in the suction chamber 14 is correspondingly small, so that the amount of the liquid refrigerant and the number of cycles sucking the liquid refrigerant after the second stroking at higher speed are reduced. In consequence, only a small abnormal pressure rise is caused after the starting of the compressor.

Figure 4:
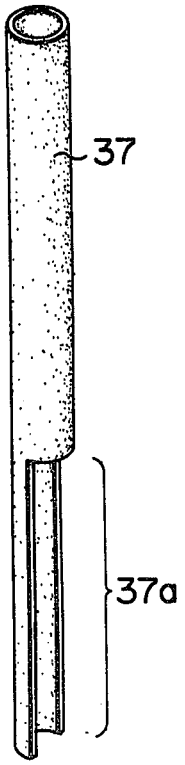
FIG. 4 is a perspective view of another example of the suction pipe.

FIG. 4 shows another form of the suction pipe. In contrast to the previously described suction pipe which stands up from the upper wall of the frame body in which the suction chamber is formed, the suction pipe 37 shown in FIG. 4 is constituted by a pipe of synthetic resin extended and inserted into corresponding suction chamber sections. Namely, the wall of the suction pipe 37 is cut and removed to provide an arcuate portion 37*a* over a certain length from the lower end of the suction pipe 37, and the arcuate portion 37*a* is inserted into the suction chamber sections 14*a*′, 14*b*, *l 14a* of the same row as viewed in FIG. 3. Since the suction pipe made of a synthetic resin is extended into and opened to the inside of the suction chamber sections 14*a*′, 14*b*, 14i a, the area of contact of the sucked refrigerant gas flowing through the suction pipe 37 into suction chamber sections 14*a*′, 14*b*, 14*a* with the metallic wall of higher thermal conductivity is further reduced to further prevent the heating of the sucked refrigerant gas.

Figure 5:
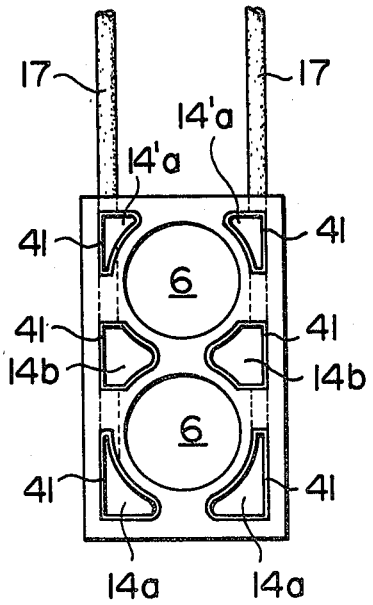
FIG. 5 shows in section the cylinder together with the suction pipe, of a hermetic motor compressor constructed in accordance with another embodiment of the invention.

FIG. 5 shows still another form in which each suction chamber section is lined at its inner surface with a film of a synthetic resin adhered thereto. Namely, a heat insulating film 41 made of a synthetic resin is adhered to the inner surface of each suction chamber 14*a*′, 14*b* , 14*a* formed around the cylinder 6. By so doing, the area of contact between the sucked refrigerant gas and the heat conductive metallic wall is further decreased to enhance the effect of prevention of heating of the sucked refrigerant gas.

Figure 6:
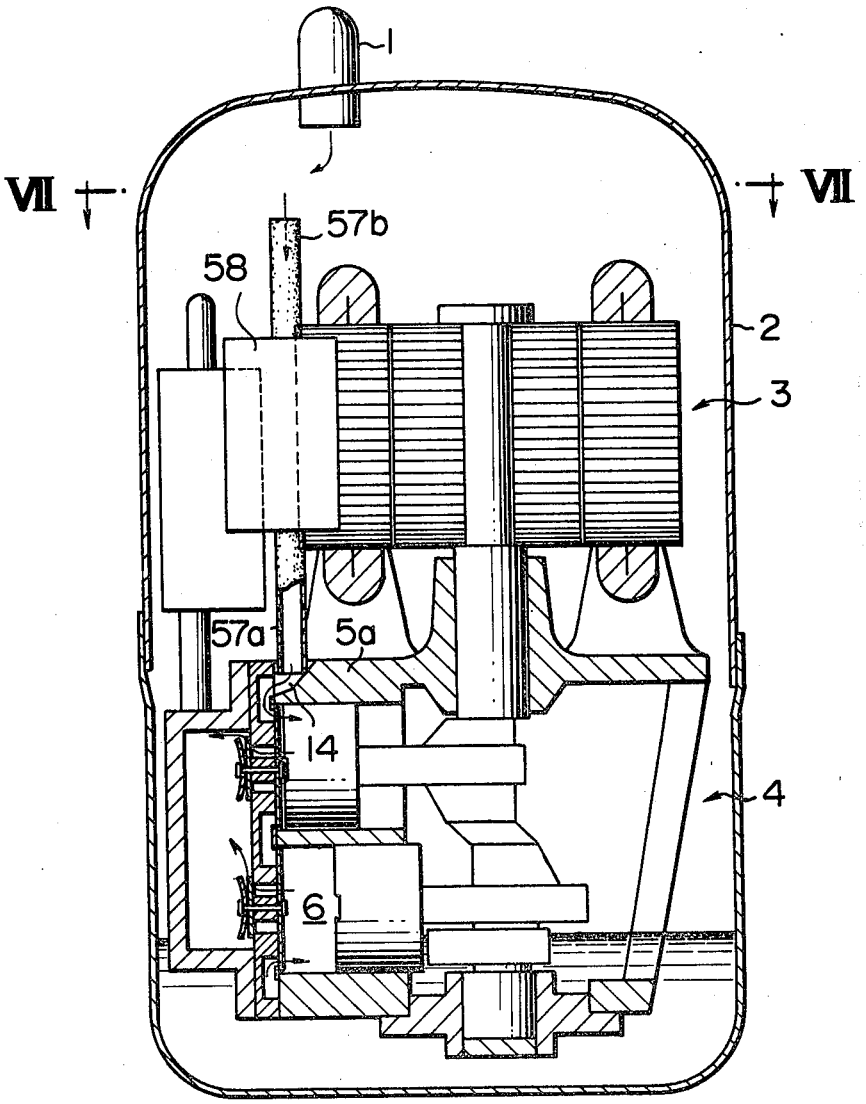
Figure 7:
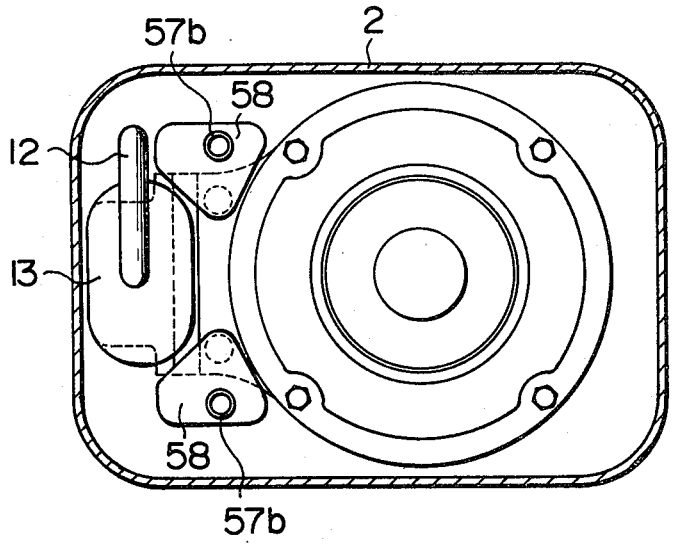
FIG. 7 is a plan view of the hermetic motor compressor shown in FIG. 6, as viewed in the direction of arrow lines VII—VII with the upper part of the closed housing cut and removed.

FIGS. 6 and 7 show a further form of the invention in which the suction passage is provided with a suction silencer, in contrast to the preceding embodiments in which the suction passage is constituted by the suction pipes.

As will be seen from FIGS. 6 and 7, each synthetic resin suction pipe, standing up from the frame body 5*a* having suction chambers 14 formed around the cylinder 6, is divided into an upper part 57*a* and a lower part 57*b* between which interposed is a suction silencer 58 made of a synthetic resin or the like material. The constructions and operations of other parts such as the motor section 3, compressor section 4 and so forth are not described in detail, because they are materially identical to those of the embodiment shown in FIG. 1.

The embodiment shown in FIGS. 6 and 7 provides, besides the advantages offered by the embodiment shown in FIG. 1, an additional advantage of elimination of noise and vibration propagated through the sucked gas. Needless to say, the arrangements shown in FIG. 4 and 5 may be adopted also in this embodiment.

Figure 9:
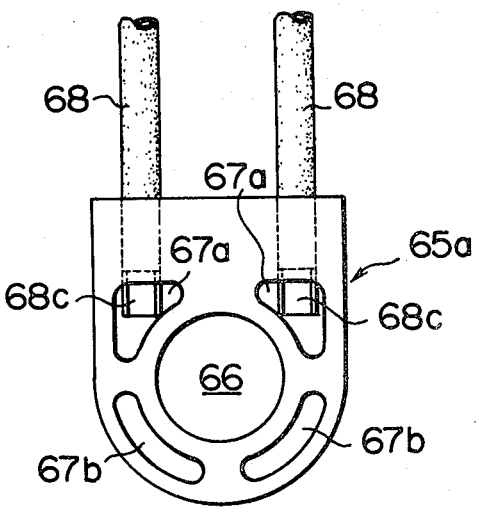
FIG. 9 shows an end view of the cylinder together with the suction pipe, of the hermetic motor compressor shown in FIG. 8.
Figure 8:
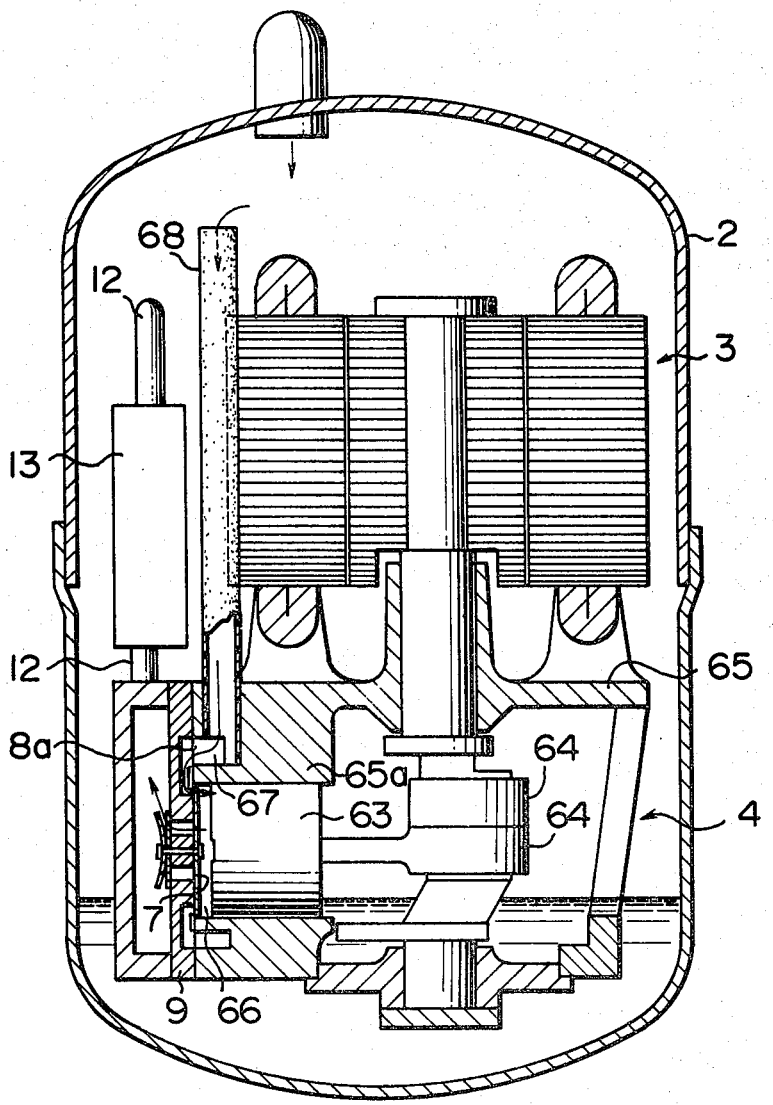
FIG. 8 is a longitudinal sectional view of a hermetic motor compressor in which a single cylinder is arranged in the frame body.

FIGS. 8 and 9 show a still further form of the invention. In contrast to the preceding embodiments in which the compressor section has two parallel cylinders, the compressor section of this embodiment has only one cylinder arranged at 90° to the axis of the crank shaft.

More specificaly, a cylinder 66 is formed in the frame 65 unitarily with the latter, at 90° to the axis of the crank shaft. A piston 63 slidably received by the cylinder 66 is connected to the crank shaft through a connecting rod 64.

As will be seen from FIG. 9, the suction chamber 67 upstream from the suction valve 7 is formed at the portion of the frame body 65*a* around the cylinder. The frame body 65*a* in which the sole cylinder is formed has a substantially horse-shoe-shaped cross-section as illustrated. Each suction chamber has a suction chamber section 67*a* formed at the corner of the frame body 65*a*, and an arcuate suction chamber section 67*b* formed at the lower part, i.e. rounded end portion, of the frame body 65*a*. These suction chamber sections 67*a*, 67*b* have small length in the axial direction of the cylinder and, hence, small volumes. A suction passage 8*a* formed in the cylinder head 9 provides a communication between both suction chamber sections 67*a*, 67*b*.

A suction pipe 68 made of a synthetic resin is extended from the upper suction chamber section 67*a* of each suction chamber, upwardly to open to an upper part of the space within the closed housing. The lower end of the suction pipe is extended to the inside of the lower suction chamber section 67*a* to open in the latter. Although not shown, a suction silencer similar to that of the embodiment shown in FIG. 6 may be inserted to an intermediate portion of the suction pipe 68 to constitute a suction passage with silencer. The constructions and operations of other portions of motor and compressor sections 3, 4 are not described here, because they are materially identical to those of the embodiment shown in FIG. 1.

In this embodiment also, the suction chamber 67 are formed in the portion of the frame body 65*a* around the cylinders 66 to have a small volume, and is spaced away from the discharge chamber, so that the transfer of heat from the hot discharge chamber to the suction chamber 67 is suppressed. In addition, the chance of the contact between the sucked gas flowing into the suction chamber 67 and the metallic wall of the suction chamber 67 is much reduced to avoid the heating of the sucked gas. Furthermore, since the suction pipe 68 is made of a synthetic resin, only small amount of heat is transmitted from the atmospheric gas in the closed housing and from the hot motor section 3 to the suction gas of low temperature flowing into the closed housing 2 through the return pipe 1 and then through the suction pipe 68.

Even when the compressor is started after a suspension of operation in the state of liquid back to permit liquid refrigerant to stay in the suction chamber 67, the abnormal pressure rise in the cylinder is sufficiently suppressed because the suction chamber 67 has a small volume to permit only small amount of liquid refrigerant to stay therein.

Thus, this embodiment offers the same advantage as the first embodiment shown in FIG. 1.

Needless to say, the arrangements described in connection with FIGS. 4 and 5 may be adopted equally in this embodiment.

What is claimed is:

1. A hermetic motor compressor having a motor compressor unit including an upper motor section and a lower compressor section connected with each other, and a closed housing accommodating said motor compressor unit and having a refrigerant gas return pipe connected to an upper part thereof so that the space in said closed housing is filled with the atmosphere of suction pressure of said refrigerant gas, said compressor section having a suction passage extending upward from an upper portion thereof and opening to an upper part of said space in said closed housing so as to introduce said refrigerant gas into said compressor section, characterized in that a suction valve and a discharge valve are provided on a cylinder head, that only a discharge chamber is in a head cover attached to said cylinder head, while a suction chamber is formed in a frame body having a cylinder, at a corner portion thereof to have a small volume, and that said suction passage is made of a synthetic resin and extends upward from the suction chamber; wherein said suction pipe is constituted by at least one suction pipe, the wall of said suction pipe being cut and removed partially to provide an arcuate pipe portion over a predetermined length from the bottom of said suction pipe, and wherein said suction chamber is constituted by a plurality of suction chamber sections arrayed in the direction of said suction pipe, said arcuate pipe portion of said suction pipe being extended and opened into said suction chamber sections.

2. A hermetic motor compressor having a motor compressor unit including an upper motor section and a lower compressor section connected with each other, and a closed housing accommodating said motor compressor unit and having a refrigerant gas return pipe connected to an upper part thereof so that the space in said closed housing is filled with the atmosphere of suction pressure of said refrigerant gas, said compressor section having a suction passage extending upward from an upper portion thereof and opening to an upper part of said space in said closed housing so as to introduce said refrigerant gas into said compressor section, characterized in that a suction valve and a discharge valve are provided on a cylinder head, that only a discharge chamber is in a head cover attached to said cylinder head, while a suction chamber is formed in a frame body having a cylinder, at a corner portion thereof to have a small volume, and that said suction passage is made of a synthetic resin and extends upward from the suction chamber; wherein said suction chamber is lined at its inner surface with a film of a synthetic resin.

3. A hermetic motor compressor having a motor compressor unit including an upper motor section and a lower compressor section connected with each other, and a closed housing accommodating said motor compressor unit and having a refrigerant gas return pipe connected to an upper part thereof so that the space in said closed housing is filled with the atmosphere of suction pressure of said refrigerant gas, said compressor section having a suction passage extending upward from an upper portion thereof and opening to an upper part of said space in said closed housing so as to introduce said refrigerant gas into said compressor section, characterized in that a suction valve and a discharge valve are provided on a cylinder head, that only a discharge chamber is formed in a head cover attached to said cylinder head, while a suction chamber of small volume is formed in a frame body having a cylinder and comprises a plurality of suction chamber sections located on the frame body at corner portions, whereby liquid refrigerant stored in said suction chamber during a suspension of operation and abnormal pressure build-up during resumption of operation are reduced; wherein said suction pipe is constituted by at least one suction pipe, the wall of said suction pipe being cut and removed partially to provide an arcuate pipe portion over a predetermined length from the bottom of said suction pipe, and wherein a plurality of said suction chamber sections are arrayed in the direction of said suction pipe, said arcuate pipe portion of said suction pipe being extended and opened into said suction chamber sections.

4. A hermetic motor compressor having a motor compressor unit including an upper motor section and a lower compressor section connected with each other, and a closed housing accommodating said motor compressor unit and having a refrigerant gas return pipe connected to an upper part thereof so that the space in said closed housing is filled with the atmosphere of suction pressure of said refrigerant gas, said compressor section having a suction passage extending upward from an upper portion thereof and opening to an upper part of said space in said closed housing so as to introduce said refrigerant gas into said compressor section, characterized in that a suction valve and a discharge valve are provided on a cylinder head, that only a discharge chamber is formed in a head cover attached to said cylinder head, while a suction chamber of small volume is formed in a frame body having a cylinder and comprises a plurality of suction chamber sections located on the frame body at corner portions, whereby liquid refrigerant stored in said suction chamber during a suspension of operation and abnormal pressure build-up during resumption of operation are reduced; wherein said suction chamber is lined at its inner surface with a film of a synthetic resin.

5. A hermetic motor compressor as claimed in claim 4, wherein said compressor section includes two cylinders formed in a frame body having a rectangular cross-section and wherein said suction chamber includes, in addition to said plurality of suction chamber sections formed at the corners of said frame body, suction chamber sections formed at both side portions of said frame body between said cylinders.

6. A hermetic motor compressor as claimed in claim 4, wherein said compressor section has a frame body having a substantially horse-shoe-shaped frame body in which a sole cylinder is formed, and wherein said suction chamber includes, in addition to said suction chamber sections formed at corners of said frame body, arcuate suction chamber sections formed at both side portions of a lower rounded end of said frame body.

* * * * *